US007568410B2

(12) United States Patent
Johnson

(10) Patent No.: US 7,568,410 B2
(45) Date of Patent: Aug. 4, 2009

(54) DIE-CUTTING BEADED MATERIAL

(75) Inventor: Michael Johnson, El Paso, TX (US)

(73) Assignee: Mexican Technologies Company, Inc., El Paso, TX (US)

( * ) Notice: Subject to any disclaimer, the term of this patent is extended or adjusted under 35 U.S.C. 154(b) by 199 days.

(21) Appl. No.: 10/979,234

(22) Filed: Nov. 3, 2004

(65) Prior Publication Data

US 2006/0093537 A1 May 4, 2006

(51) Int. Cl.
*B26D 1/00* (2006.01)
*B26F 1/44* (2006.01)

(52) U.S. Cl. ..... 83/13; 83/40; 83/97; 83/164; 83/655; 422/245.1; 76/107.1

(58) Field of Classification Search ..... 83/13, 83/86, 97, 164, 655, 620, 262, 691, 699.11, 83/452, 462, 588, 637, 685, 926, 175, 18, 83/382, 566, 40; 422/245.1; 76/107.1, 107.8
See application file for complete search history.

(56) References Cited

U.S. PATENT DOCUMENTS 3,200,025 A * 8/1965 Edmondson ..... 156/209
3,826,170 A * 7/1974 Jones et al. ..... 83/657
3,848,452 A * 11/1974 Gargrave ..... 72/448
4,306,475 A * 12/1981 Stefanic et al. ..... 83/99
4,959,115 A * 9/1990 Lacy ..... 156/264
5,045,009 A * 9/1991 Cordingley et al. ..... 445/30
5,676,032 A 10/1997 Johnson

OTHER PUBLICATIONS

Internet Printout: http://www.bp.com/home.do—Understand BP, dated Mar. 11, 2004.
Internet Printout: http://www.fabricsandfibers.com/products/furniture.asp—furniture, bedding and automotive, dated Mar. 11, 2004.
Internet Printout: http://www.fabricsandfibers.com/about/default.asp—who we are, dated Mar. 11, 2004.

* cited by examiner

*Primary Examiner*—Ghassem Alie
(74) *Attorney, Agent, or Firm*—Banner & Witcoff, Ltd.

(57) ABSTRACT

A method is provided for cutting beaded fabric that includes a bead attached to cloth-like material. According to one embodiment, a continuous length of the beaded fabric is fed through a guide into a die-cutting press and is die-cut via a soft anvil die while the material is retained in the guide. A guide is also provided for retaining the beaded fabric during die-cutting operations. Pre-cut beaded fabric is also provided that is easily separated into tie-downs. A continuous cutting method is also provided for forming individual tie-downs from a combination of fabric and plastic material used to form a bead on the fabric. The continuous cutting method may include die-cutting beaded fabric, placing a mark on a bead of the beaded fabric, and severing the bead at the mark.

14 Claims, 17 Drawing Sheets

DIE-CUTTING BEADED MATERIAL

TECHNICAL FIELD

This invention relates generally to die-cutting fabric having a bead attached thereto. More particularly, the invention relates to a die press with a guide for cutting the same, to a soft anvil method for die-cutting the same, and to a length of beaded fabric with pre-cut tie-downs formed therein.

BACKGROUND

A tie-down is a type of item that is used for attaching sheet material to an article, such as for attaching a seat cover to an automobile seat frame. Conventional tie-downs are made of a strip of fabric connected to a rigid plastic bead. The rigid bead attaches the fabric strip to the article, such as a seat frame, that is designed to accept it by permitting the bead to slide into a channel of the article. The fabric portion of the tie-down is sewn to material that is to be secured to the article. In a car seat example, the fabric portion of the tie-down is sewn to an edge of the seat cover. Retention of the bead in the seat frame channel secures the seat cover to the seat frame.

FIG. 1 shows a conventional tie-down manufacturing process 310. As shown, fabric from a roll 312 proceeds through an extruder 314 wherein a polymer bead is extruded onto the fabric to form a continuous length of beaded fabric 316. The polymer bead is cooled as it passes through a cooling unit 318, after which beaded fabric 316 passes through a male/female die-cut press 320. Male/female die-cut press 320 cuts tie-downs of a determined length and shape 322 out of the continuous length of beaded fabric 316. The tie-downs exit male/female die cut press 320 as individual units that are handled for storage or further processing. Tie-downs with a number of imperfect cuts, such as those having frayed edges or incomplete cuts, proceed through a rework station 324 where the cuts are manually improved using scissors.

Conventional manufacturing process 310 suffers various drawbacks. For instance, male/female die-cut operation 318 may create a large number of unacceptable products by incompletely cutting through the fabric strips and/or the beads, or by fraying the edges of the fabric at the cut lines. Manual reworking process 322 may improve such unacceptable products, but reworked products typically have only marginal quality and are expensive to produce compared with non-reworked products. Further, such reworking requires manual inspection for unacceptable products, which may not catch all of the unacceptable products. In addition, immediate handling of individual tie-downs as they exit male/female die cut press 320 disrupts the flow of continuous processing.

An alternative conventional tie-down manufacturing process includes laser-cutting the tie-downs instead of using die-cut press 320. However, laser-cutting may be slower than die-cutting, often requires expensive equipment, and may require further processing to cut the polymer bead.

Accordingly, a need exists for an improved manufacturing process for tie-downs. Further, a need exists for an improved die for cutting the same.

SUMMARY

In order to overcome drawbacks of the prior art and/or provide an alternate arrangement, aspects of the present invention provide a method for cutting beaded fabric, which includes a bead attached to fabric. According to an embodiment of the invention, the method includes extruding a bead onto fabric to form the beaded fabric, rolling the beaded fabric onto a large-diameter roll, guiding the beaded fabric through a guide of a die press, and die-cutting the beaded fabric via a soft anvil die press while the material is retained in the guide. Aspects of the present invention further provide a guide for retaining the beaded fabric during die-cutting operations. Other aspects of the present invention include a length of beaded fabric having pre-cut tie-downs formed therein, from which the tie-downs are easily separated as desired.

A further aspect of the invention provides a continuous cutting method for forming individual tie-downs from beaded fabric. The continuous cutting method according to an embodiment of the invention includes die-cutting beaded fabric, placing a mark on the bead, and severing the bead as indicated by the mark. Other features and advantages of various aspects of the invention will become apparent with reference to the following detailed description and figures.

BRIEF DESCRIPTION OF THE DRAWINGS

The invention will be described in detail in the following description of preferred embodiments with reference to the following figures wherein.

DETAILED DESCRIPTION OF THE PREFERRED EMBODIMENTS

Figure 1:
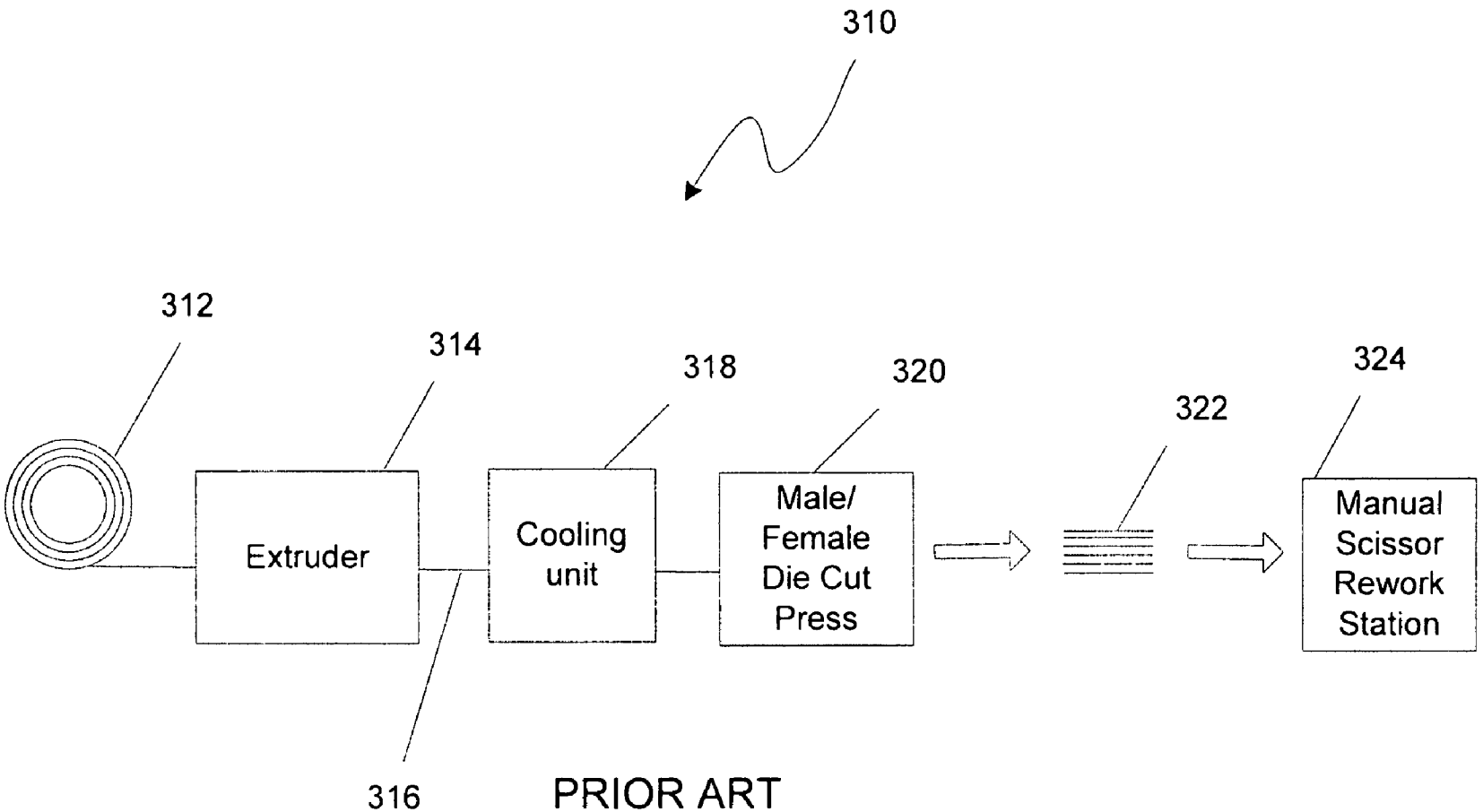
PRIOR ART FIGURE 1
FIG. 1 illustrates a prior art process for making tie-downs.

The various aspects of the invention may be embodied in various forms. The following description shows by way of illustration various embodiments in which aspects of the invention may be practiced. It is to be understood that other embodiments may be utilized and structural and functional modifications may be made without departing from the scope of the present invention. Referring now to FIGS. 2-9 in general and FIGS. 2-4A in particular, a process 110 is shown according to an embodiment of the invention for cutting beaded fabric 120, which includes a bead 1 attached to fabric 2 and may optionally include one or more holes 127 formed through the fabric. In general, tie-downs 126 are formed via process 110 by forming a continuous length of beaded fabric 120, die-cutting tie-down shapes into the beaded fabric 120, and separating the shapes into individual tie-down units. As shown in FIG. 3B, a tie-down unit can be attached to an article, such as a seat frame of an automobile 129, via bead 1 being received into a channel 28. Process 110 produces tie-downs 126 in an efficient manner by keeping the tie-down shapes in an integrated unit with the beaded fabric 120 until it is desirable to separate the units. Further, process 110 is a streamlined, efficient process for making tie-downs that requires little, if any, reworking of the finished product.

Figure 2:
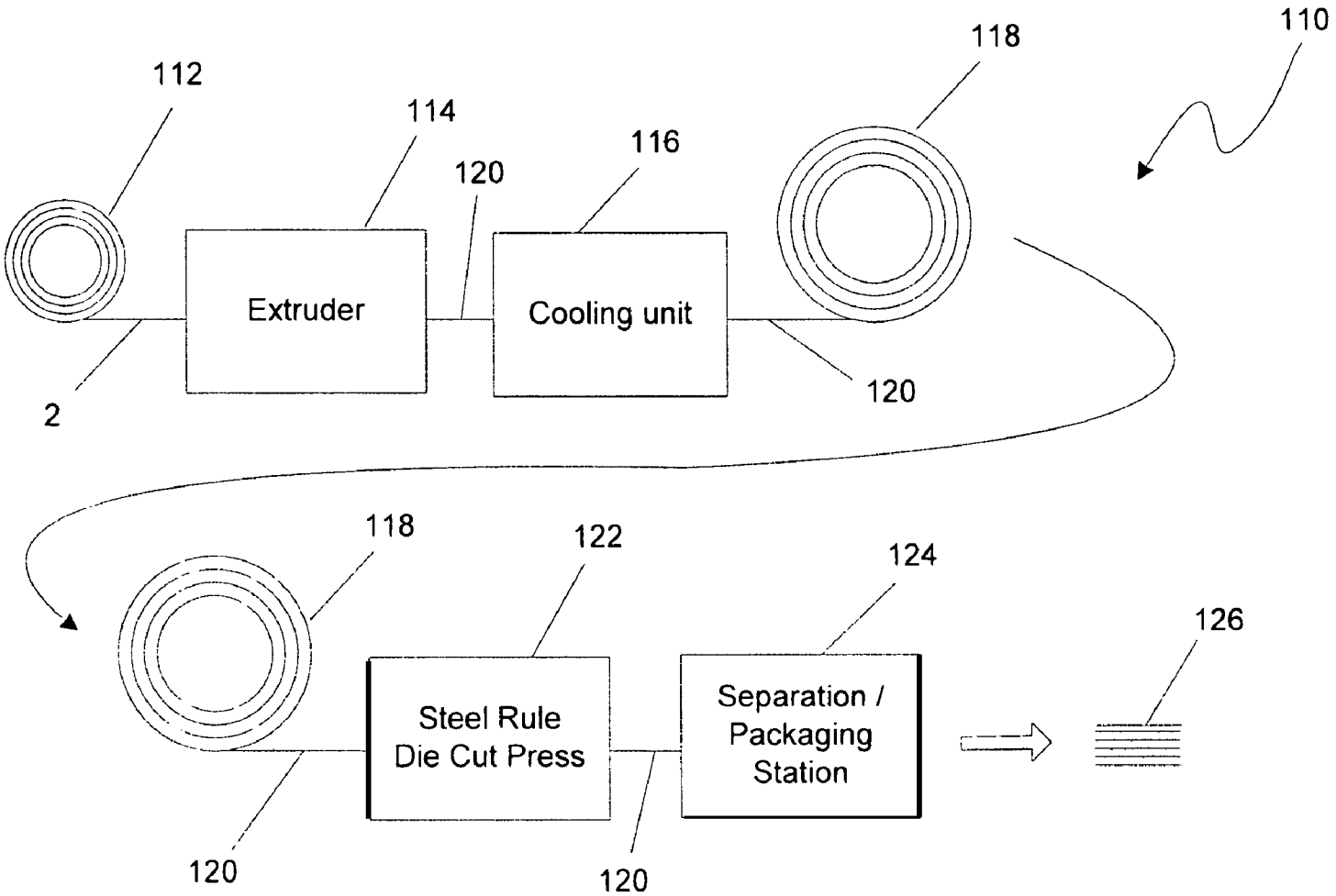
FIG. 2 illustrates a process for forming tie-downs according to an embodiment of the invention.
Figure 3A:
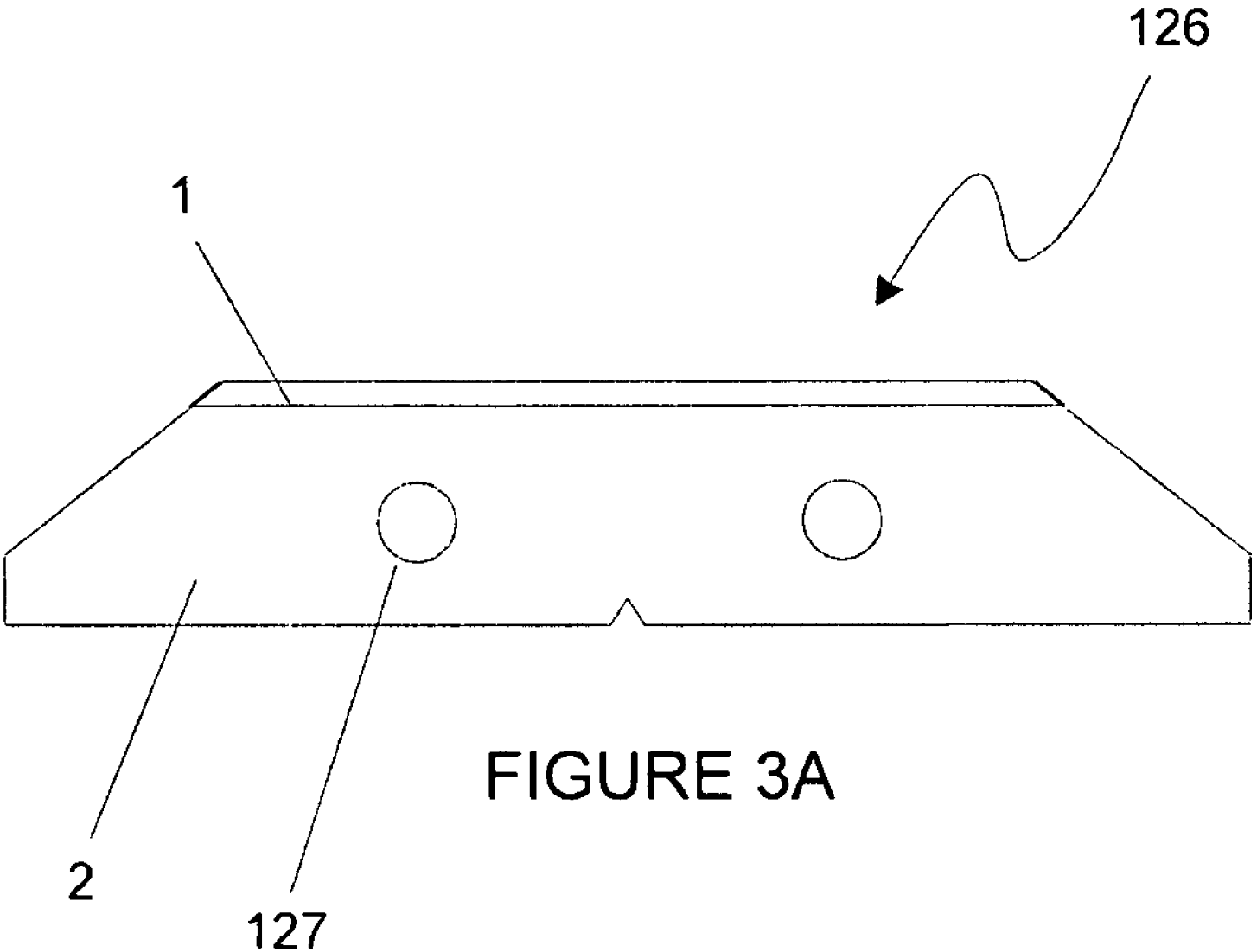
FIG. 3A is a top view of a tie-down formed via the process of FIG. 2.
Figure 3B:
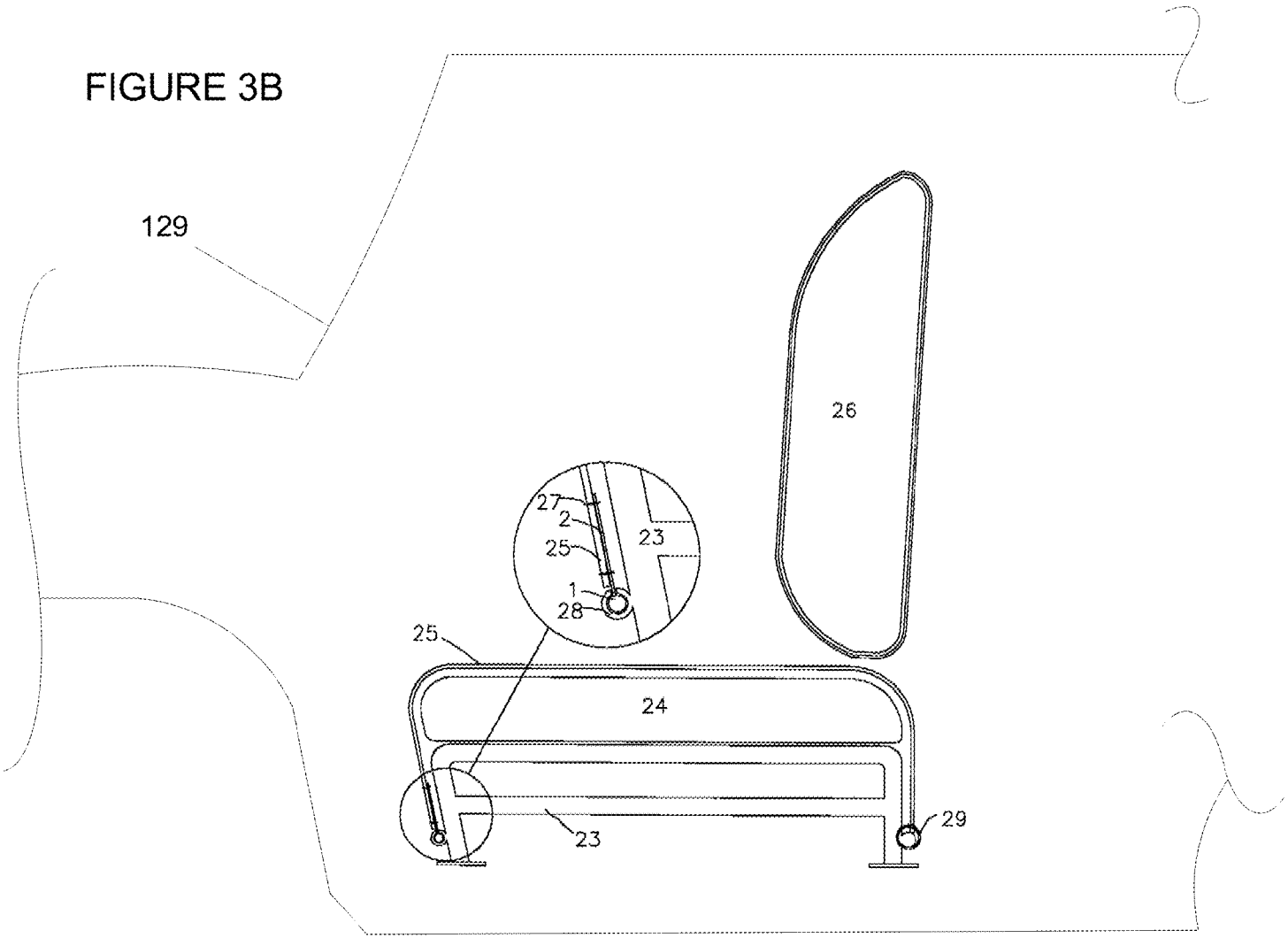
FIG. 3B is an elevation view of a seat showing, as an example, the tie-down of FIG. 3A retaining a seat cover to a seat frame.

As shown in FIG. 2, fabric 2 from fabric roll 112 proceeds through an extruder 114 in which a polymer bead 1 is extruded onto fabric 2. A continuous line of beaded fabric 120 proceeds from extrusion process 114 into a cooling unit 116 for cooling extruded polymer bead 1. Cooling unit 116 may include a cooling pool (not shown) containing a cooling medium, such as water, through which beaded fabric 120 is advanced. The cooled beaded fabric 120 is subsequently rolled onto a relatively large roll 118 for transportation to a further processing location or for storage. Roll 118 at the first layer of beaded fabric 120 preferably has a diameter larger than 42 inches, and more preferably has a diameter of about 48 inches. Such a large diameter prevents damage to polymer bead 1 due to excessive bending.

The term "fabric" as used herein means a sheet of flexible material. Fabric 2 is preferably a textile sheet made of non-woven olefin fibers, such as polyethylene or polypropylene. As an example, fabric 2 may include material known commercially as DUON, which is manufactured by Phillips Fiber Corp. Sheet material made of olefin fibers is desirable for its high strength, wear-resistance and resilience characteristics. However, other sheet materials may be used as desired, such as natural woven or non-woven textiles, and synthetic woven or non-woven textiles. Polymer bead 1 may be made from an olefin polymer, such as polyethylene or polypropylene, which provides a substantially rigid bead at ambient conditions and attaches well to fabric via an extrusion process, and is preferably made from polypropylene. Other polymers or plastics may also be used as desired.

Non-woven synthetic materials, such as DUON, include layers of fibers oriented in numerous directions. The orientation of fibers provides the advantage of high strength in multiple directions, but it also makes the material more difficult to cut completely during manufacturing operations. For instance, male/female die cut press 318 of prior art method 310 shown in FIG. 1 often does not cut fibers that are oriented along cut lines and that fall between male and female shear surfaces, which results in frayed, incomplete or other undesirable cuts. The problem is exacerbated when the male/female die wears and does not maintain tight tolerances between the shear surfaces, which permits more fibers to fit between the shear surfaces and avoid being cut.

Process 110 makes use of a steel rule die cut press 122 to more completely cut through the fabric of beaded fabric 120 than prior art systems. Steel rule dies in general are advantageous for repetitively cutting specific shapes, such as for automotive interior components and clothing items, and are particularly advantageous for cutting shapes in fabrics. As shown in FIG. 2, tie-downs 126 are produced by feeding beaded fabric 120 from beaded fabric roll 118 into steel rule die-cut press 122. Steel rule die-cut press 122 includes a cutting die such as steel rule die 130 (see FIG. 4), which is mounted to a platen of die-cut press 122 for cutting shapes in beaded fabric 120.

Figure 5:
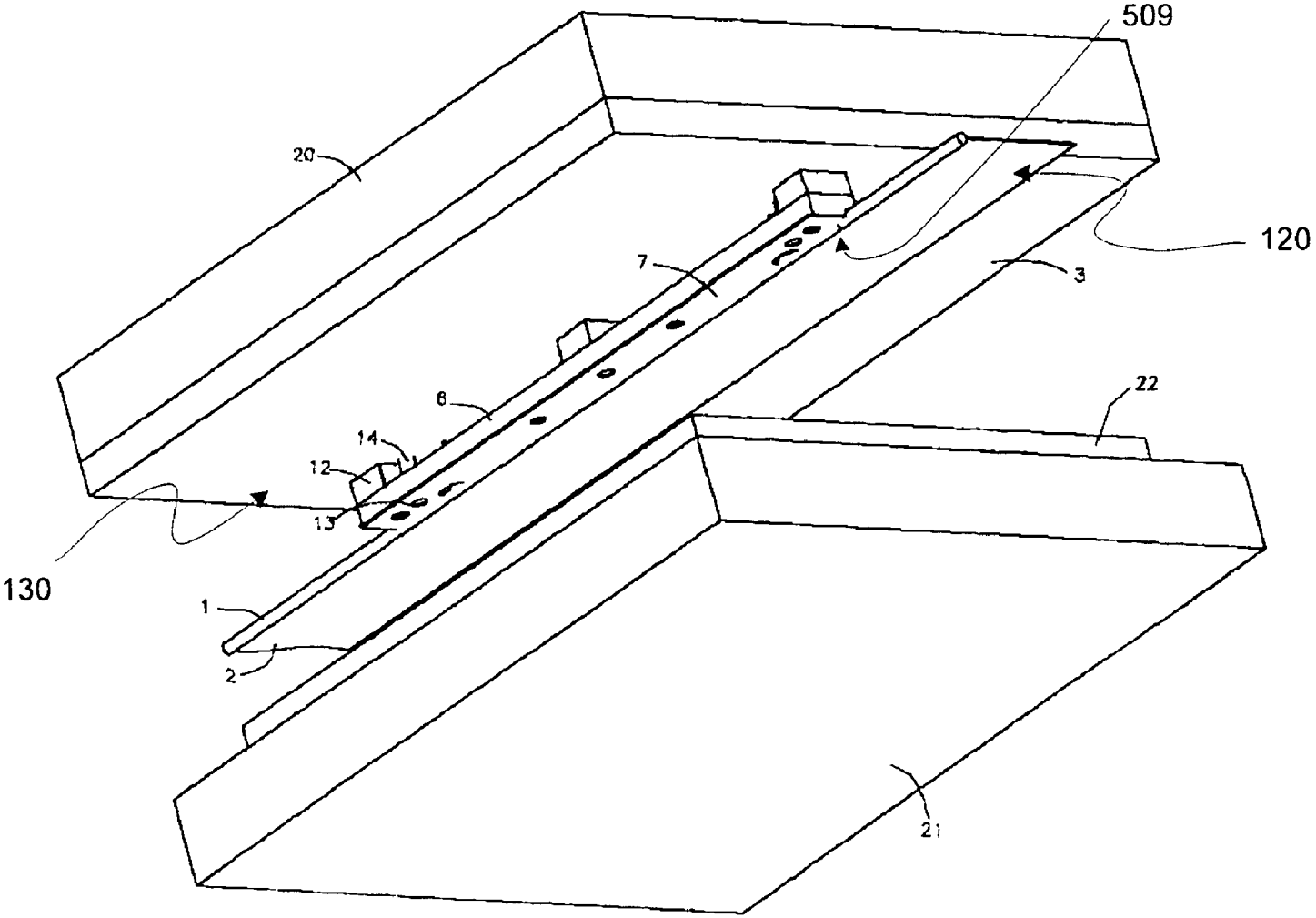
FIG. 5 is a perspective view of the cutting die of FIG. 4A shown mounted on an upper platen of a die press that may be used in the process of FIG. 2.

Steel rule die 130 includes a length of steel rule 4 having a sharpened cutting edge 19 extending away from a die board 3 mounted to either an upper 20 or a lower platen 21 of die-cutting press 122 (see FIG. 5). Preferably, steel rule die 130 is used as a soft anvil die in which steel rule 4 presses against an anvil surface during the cutting operation that is softer than that of the steel rule. As such, a moveable plastic cutting pad 22 is disposed opposite steel rule 4 abutting one of platens 20, 21, against which cutting edge 19 cuts during operation. As the platens of cutting press 122 are moved toward each other, beaded fabric 120 is cut when sharpened cutting edge 19 of steel rule 4 moves through beaded fabric 1 and is displaced slightly into cutting pad 22. Cutting pad 22 provides a firm support surface against which fabric 2 rests during the cutting operation, but is also flexible enough to receive cutting edge 19 of steel rule 4 as it cuts through fabric 2.

To permit cut tie-down units to be retained as an integral unit with beaded fabric 120 as the beaded fabric exits steel rule die press 122, steel rule 4 contains nicks 5 (see FIGS. 7 and 8) that are aligned with the bead 1 of beaded fabric 120 when mounted in die-cutting press 122. Nicks 5 allows for a partial (incomplete) cut of bead 1, which avoids completely severing bead 1 during die-cutting. Partial severing of bead 1 permits the cut tie-down to remain integrated with beaded fabric 120 to allow beaded fabric 120 to be pulled or pushed from die-cutting press 122 for a continuous feeding of the beaded fabric. In operation, die-cutting press 122 lowers to cut the desired shape of the final product in beaded fabric 120 and subsequently opens to allow the cut material to be fed from the press. Although bead 1 is not completely cut, fabric 2 is preferably completely cut to outline the tie-down. As desired, marking notches 16 may be provided along steel rule 4.

Fabric 2 is preferably wider than the width of tie-downs 126 cut therein in order to improve integration of cut units within beaded fabric 120 and thereby assist continuous processing of the tie-downs, and to provide consistently dimensioned tie-downs. As such, excess uncut fabric 121 (see FIG. 7) remains along one side of each tie-down after the respective tie-down is cut within beaded fabric 120. The excess uncut fabric 121 acts along with the incompletely cut beads 1 to provide tie-down units that are integrated within continuous beaded fabric 120 after exiting die-cut press 122. Providing fabric that is wider than the width of tie-downs 126 may permit more consistently dimensioned tie-downs 126, as opposed to using beaded fabric having the same width as the final tie-down width. Alternatively, however, fabric 2 may be the final width needed for tie-downs 126, which eliminates excess uncut fabric 121.

As shown in FIG. 2, tie-down units cut into beaded fabric 120 are subsequently separated at Separation/Packaging Station 124 where the individual tie-downs 126 are separated and packaged, or handled further as desired. Individual tie-downs 126 are separated 124 by breaking or cutting uncut portions of bead 1 at the cut locations and removing the tie-down from beaded fabric 120. Alternatively, beaded fabric 120 with integrated cut tie-downs may be rolled onto a take-up roll (not shown) for separation later. Optionally, small lands 168 (see FIG. 8A) may intentionally remain as uncut fabric in the cut lines of fabric 2 to improve integration of the tie-downs within beaded fabric 120. The small lands 168 may easily be broken when tie-downs 126 are removed from beaded fabric 120. The lands 168 may be formed via small nicks in the cutting edge 19 of steel rule 4.

As shown in FIGS. 4-8, steel rule die-cut press 122 includes an upper platen 20, a lower platen 21, and a piece of steel rule 4 mounted directly to the upper platen or to the upper platen via a base substrate, such as die board 3. Steel rule 4 may be attached by mounting it in grooves, welding or via other appropriate techniques. Bends in steel rule 4 form a shape that is typically provided on three sides of tie-down 126. The fourth side of the product is defined by bead 1. FIG. 4B shows another embodiment of the steel rule die for use with beaded fabric 120 in which the width of the beaded fabric is the width of the finished tie-downs 126. As shown, steel rule 204 of die rule die 230 includes a pair of opposing steel rule portions 205 for forming the end portions of the tie-downs. However, steel rule 204 does not include a steel rule portion for forming the third side of tie-down 126 that is opposite bead 1 and which forms excess uncut fabric 121.

Figure 4A:
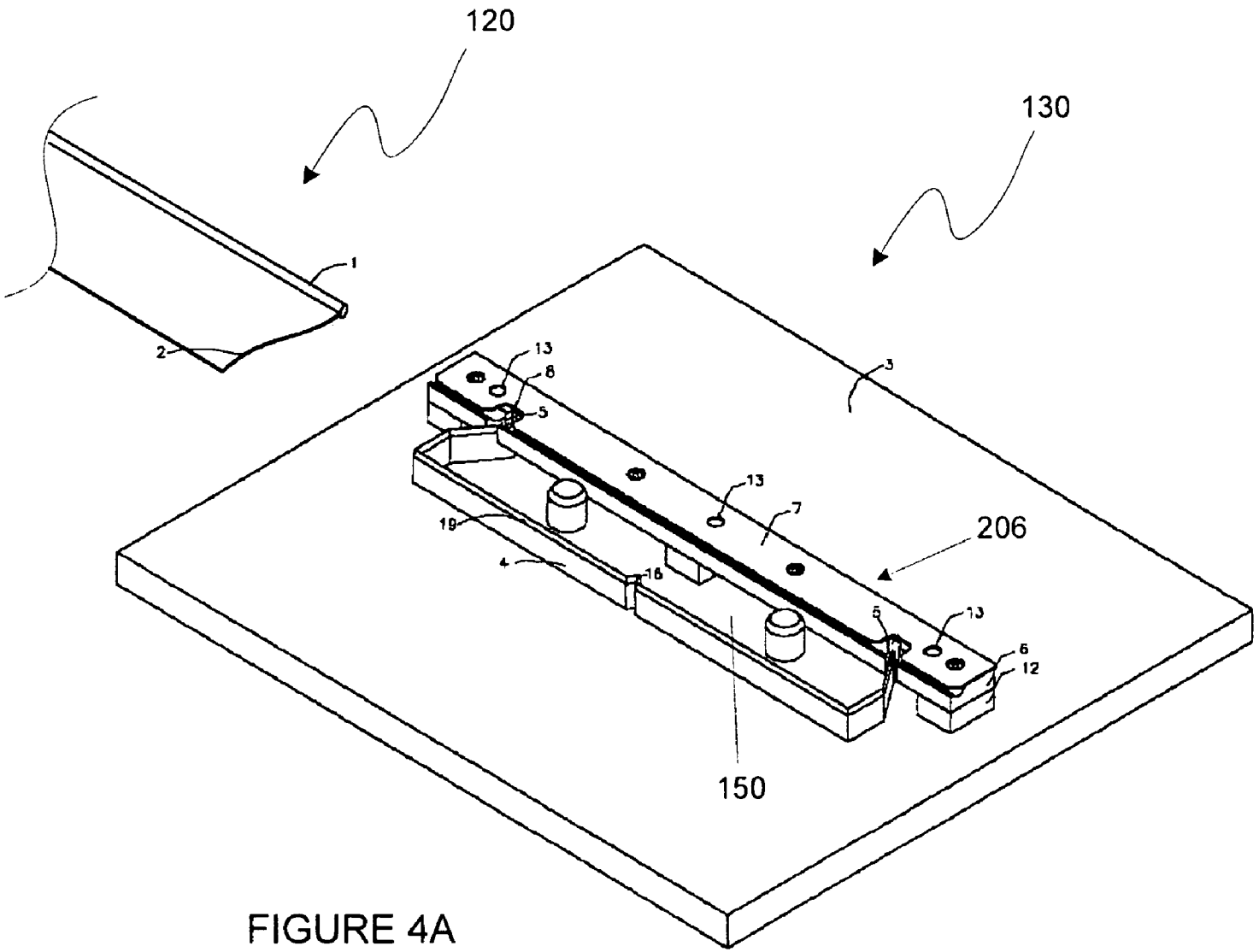
FIG. 4A is a perspective view of a cutting die according to an embodiment of the invention that may be used in the process of FIG. 2.
Figure 4B:
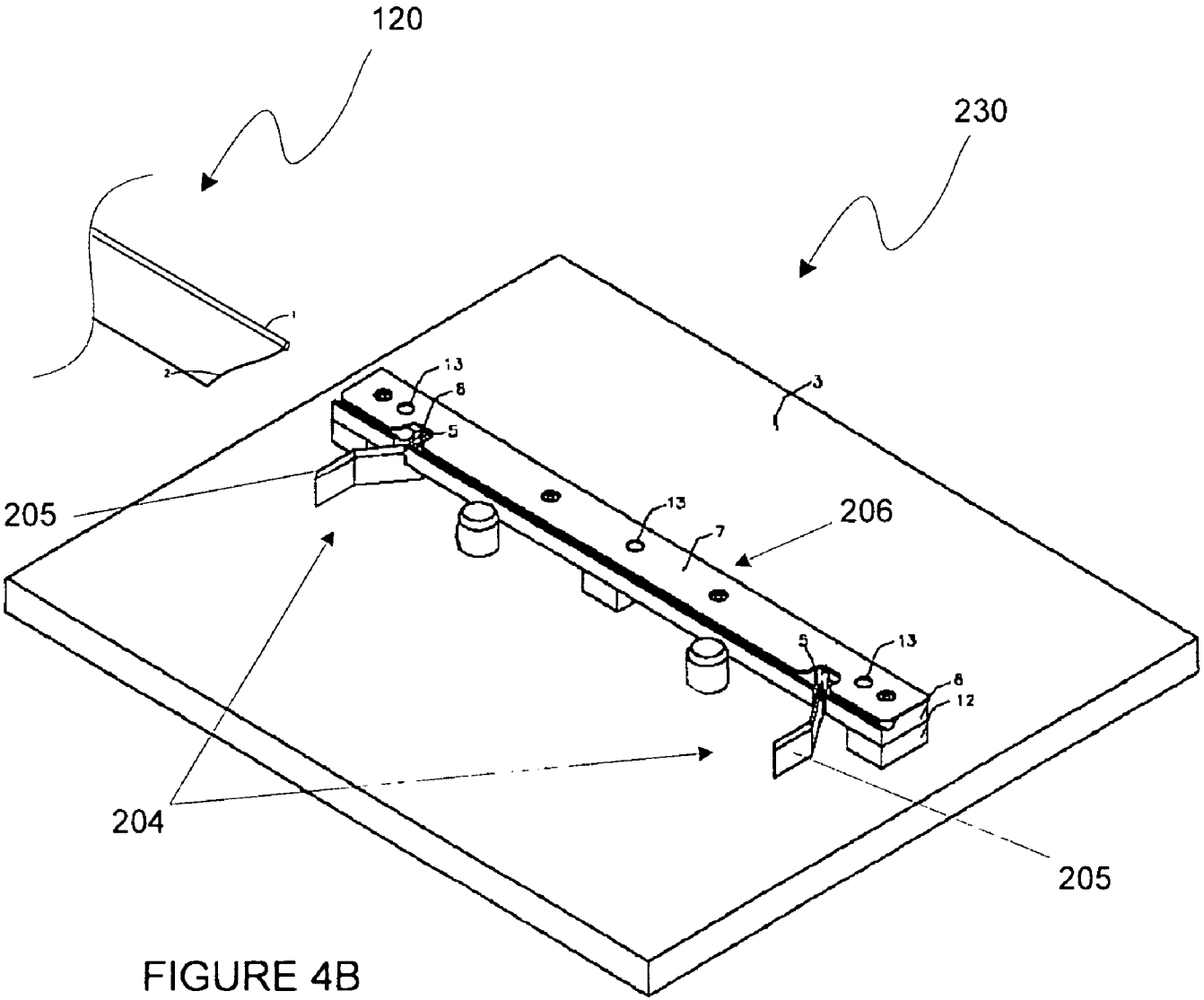
FIG. 4B is a perspective view of a cutting die according to another embodiment of the invention that may be used in the process of FIG. 2.

As shown in FIG. 4A, steel rule die 130 is fitted with a guide 206 mounted on one or more resilient members 12, which, for example, may be made of rubber, foam, springs, cantilever arms or other biasing devices. Guide 206 retains beaded fabric 120 in the proper location during die cutting. Guide 206 is preferably a continuous or substantially continuous unit that extends at least the length of steel rule 4 to provide improved control of beaded fabric, reduce variation between cut parts, and permit tighter tolerances to be maintained for tie-downs 126. Guide 206 includes cutouts 5, which permit steel rule 4 to extend across bead 1 as it is retained in a channel 10 (discussed below) of guide 206. Permitting steel rule 4 to extend across bead 1 provides improved die-cutting of the bead compared with terminating the steel rule at or within channel 10.

Figure 13:
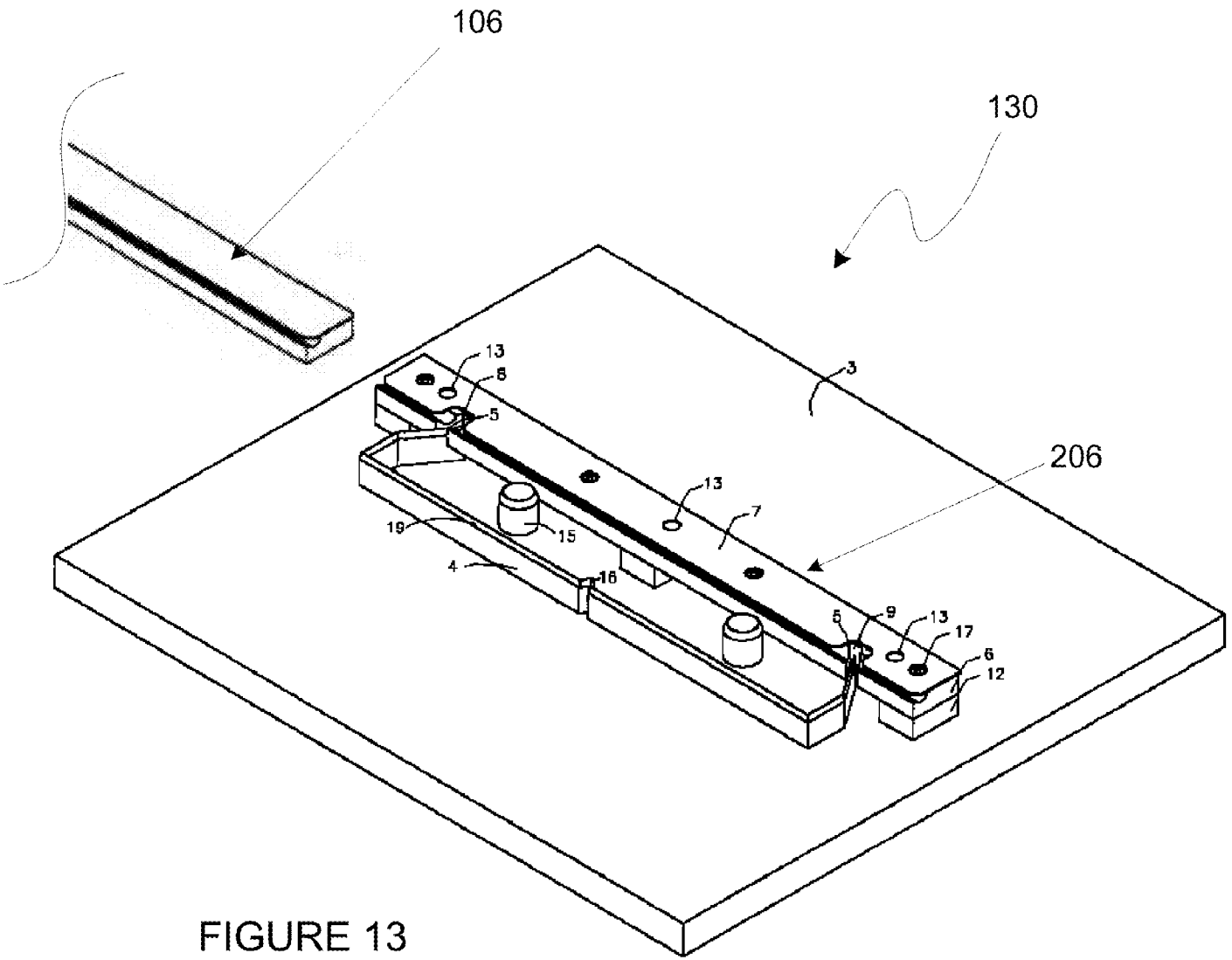
FIG. 13 is a perspective view of a cutting die according to another embodiment of the invention that may be used in the process of FIG. 2.

Guide 206 may extend beyond the length of steel rule 4 to pre-align beaded fabric 120 as it enters die-cut press 122 and to keep beaded fabric 120 oriented in the direction of flow as it exits die-cut press 122. In a further embodiment shown in FIG. 13, guide 206 may include a pre-alignment guide 106 to align beaded fabric 120 for entry into guide 206 and die-cut press 122. In another embodiment, multiple small guides may be used to retain beaded fabric 120 during die-cutting operations.

Figure 8:
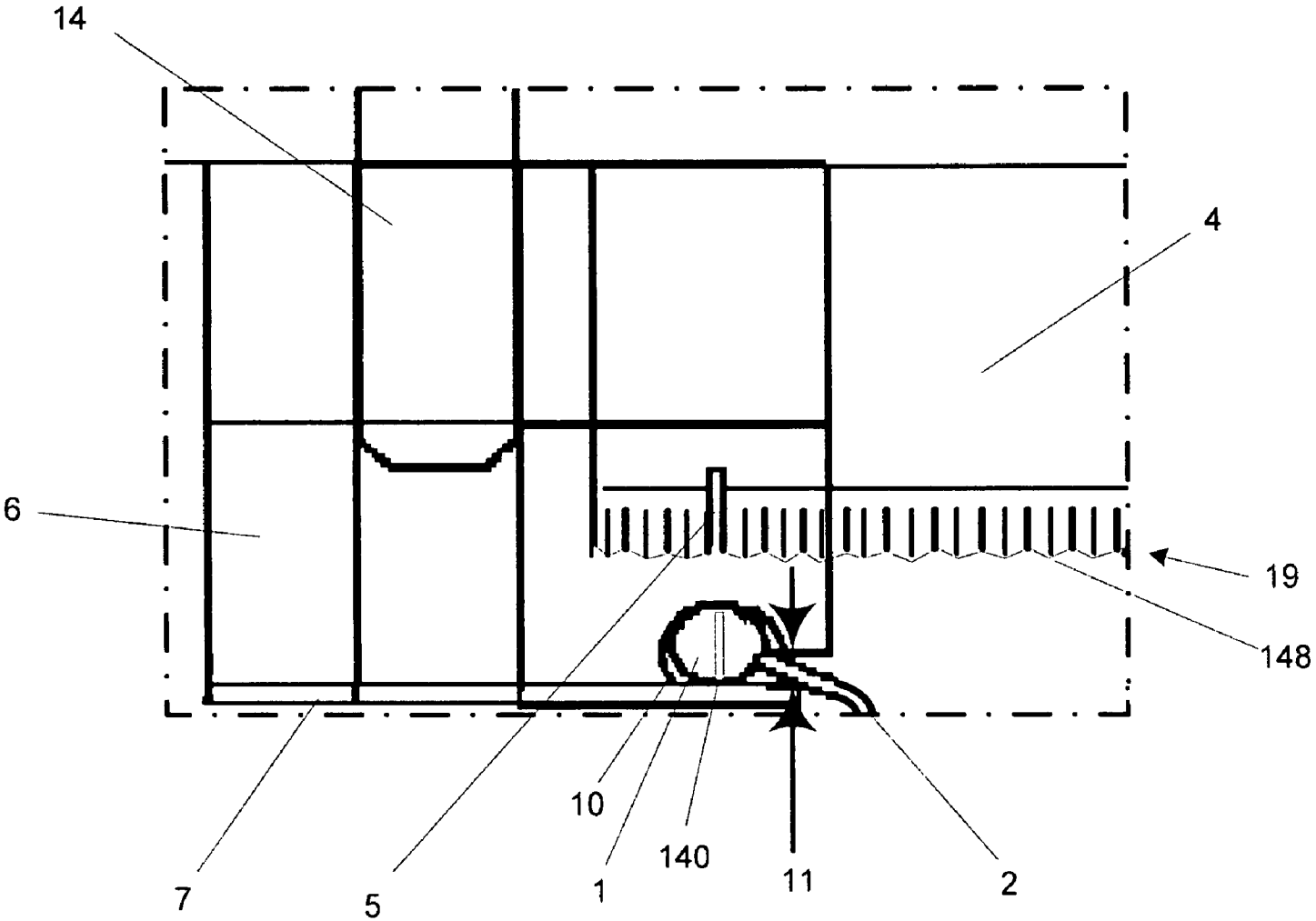
FIG. 8 is an enlarged side view of Detail 8 of FIG. 6.

As shown in FIG. 8, guide 206 forms a channel 10 of sufficient size to allow the maximum size of bead 1 to pass freely through it. A slot 11 is formed along one side of channel 10 to allow fabric 2 (but not the bead 1) to pass therethrough. As such, channel 10 and slot 11 securely retain bead 1 and orient fabric 2 for the die-cutting operation. Guide 206 may be formed from a base 6 and a cap 7 provided along an outer surface of base 6 and extending over channel 10, which forms a protective barrier on the outer surface of guide 206. Cap 7 protects base 6 by contacting cutting pad 22 during die-cutting operations instead of base 6. Cap 7 also forms an outer portion of channel 10 and slot 11. Cap 7 is preferably made of thin metal to permit fabric 2 to extend through slot 11 at a relatively small angle or substantially flat. For example, cap 7 may be made from carbon steel about 0.042 of an inch thick.

Base 6 can be formed from a rigid, wear resistant material, such as metal or a rigid polymer. For example, the plastic known as DELRIN ACETAL provides a rigid, low-friction material that can maintain tight tolerances for retaining beaded fabric 120 during processing while resisting wear over time. Base 6 is mounted on resilient members 12, such as rubber pads or foam pads, such that the height of channel 10 is greater than the height of steel rule 4, which allows free movement and passage of bead 1 and fabric 2 over steel rule 4 through channel 10 between cutting operations.

Figure 7:
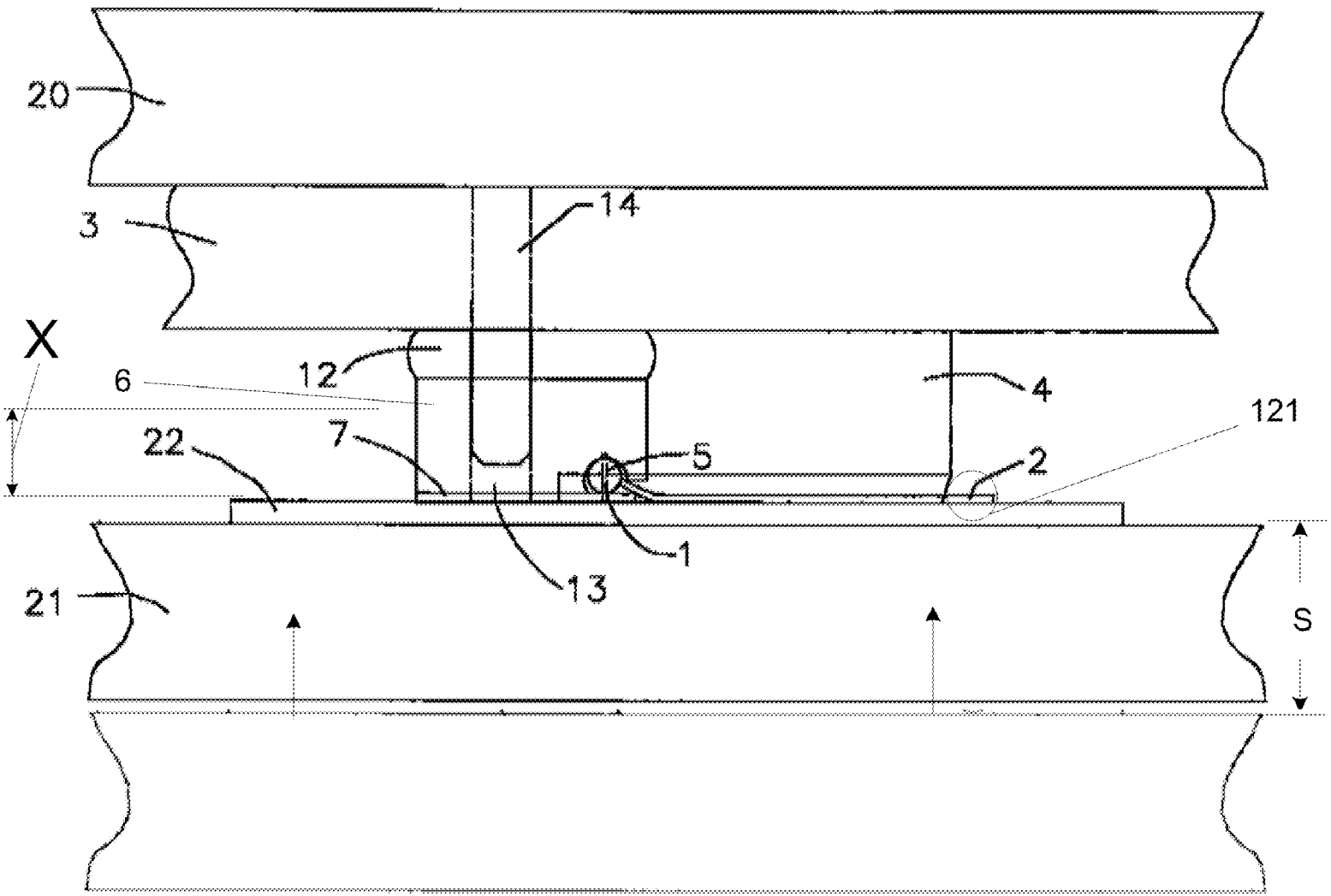
FIG. 7 is a front view of the cutting die of FIG. 5 shown in a pressed configuration.

During die-cutting operations, platens 20 and 21 are pressed together causing cutting pad 22 located on lower platen 21 to contact guide top 7 and force guide 206 toward upper platen 20. As shown in FIG. 7, resilient members 12 compress during the cutting operation to permit movement of guide 206 toward upper platen 20. As such, cutting edge 19 of steel rule 4 slices through fabric 1 as guide 206 moves to permit steel rule 4 to extend into cutting pad 22. Further, portions of steel rule 4 disposed within cutouts 5 are brought into contact with bead 2 and slice therethrough as guide 206 moves toward the upper platen 20 along an axis of the cutouts. Preferably, resilient members 12 are formed from Grey medium hard ejection rubber, such as is available from American Die Supply, Inc., which has been found to yield acceptable results.

Figure 6:
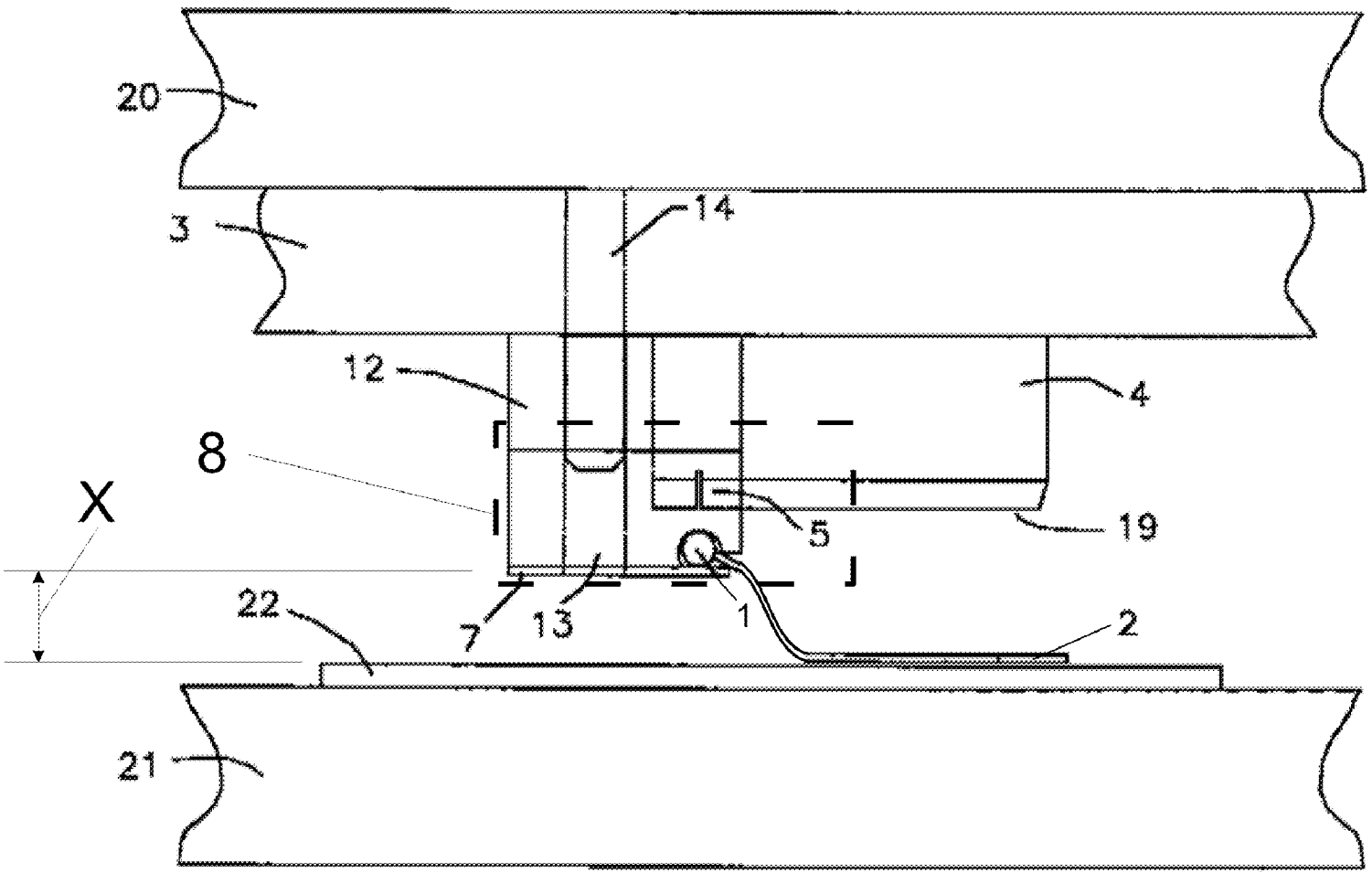
FIG. 6 is a front view of the die press of FIG. 5 shown in an unpressed configuration.

As shown in FIGS. 6-8, guide pins 14 affixed to upper platen 20 and received into guide slots 13 of guide 206 maintain the proper alignment of guide 206 during die-cutting operations. As such, guide 206 generally floats on top of resilient members 12 while being oriented via guide pins 14 and guide slots 13. The guide pins and corresponding guide slots preferably have tight size and location tolerances, such as about +/−0.010 of an inch in size (e.g., diameter) and about 0.020 of an inch in location, which permit tight tolerances to be similarly be maintained in the manufactured tie-downs 126.

As shown in FIGS. 6 and 7, die cut press 122 may have a relatively short stroke length X. The stroke length is generally the distance the platens move relative to one another during the die-cut operations. In the embodiment of FIG. 7, lower platen 21 travels stroke length X toward upper platen 20 for die-cutting beaded fabric 120. A short stroke length can reduce the chance of wrinkles forming in fabric 2 as the platens are brought together. Stroke length X may be about 4 inches or less, which provides enough space to move beaded fabric 120 between die-cut operations and to move cutting pad 22 as needed, while reducing the distance fabric 2 moves along cutting pad 22 during die-cutting operations. Preferably, however, stroke length X is about 2 inches or less and more preferably is about 1 inch or less. Even more preferably, stroke length X is about ¾ of inch, which provides enough space to slide beaded fabric along guide 206 and to permit cutting pad 22 to translate between press strokes while significantly reducing the amount of fabric 2 that can become wrinkled or improperly disposed during the die-cut press operation.

Figure 5A:
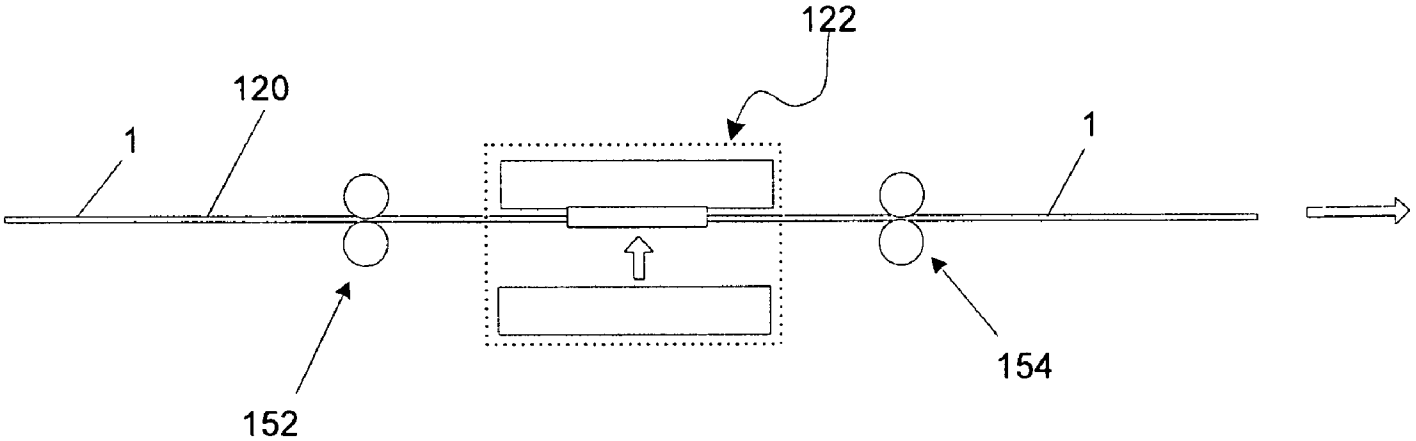
FIGS. 5A and 5B illustrate processes for advancing beaded material through the cutting die of FIG. 5 according to embodiments of the invention.
Figure 5B:
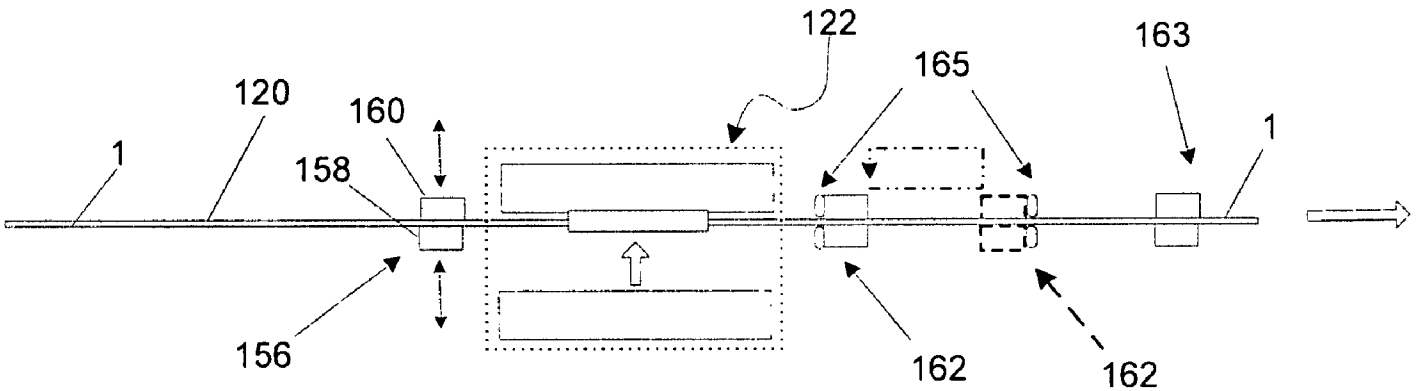

FIGS. 5A and 5B illustrate cutting and moving operations for beaded fabric 120 according to embodiments of the invention. As shown in FIG. 5A, a pair of opposing rollers 152 disposed at an entry end of die cut press 122 may be used as an advancement mechanism to advance beaded fabric 120 through the die cut press as needed during an automated cutting operation, or to support beaded fabric 120 during manual operations. Opposing rollers 152 preferably sandwich bead 1 between themselves in opposing concave regions (not shown) that substantially surround bead 1. Opposing rollers 152 may be biased toward each other to ensure a tight fit against bead 1. One or more of the opposing rollers 152 may be powered to control advancement of bead 1 and/or to lock bead 1 in a desired position during cutting operations. Powered rollers may be controlled via program logic instructions and a controller. They may also be free rolling to support bead 1 without controlling advancement. A second pair of opposing rollers 154 similar to opposing rollers 152 may further support bead 1 during operations. Preferably, one or both of second pair of opposing rollers 154 are powered to advance beaded fabric 120 along process 110 after die cut press 122 cuts beaded fabric 120. Additional sets of rollers may be used to provide further support and/or control advancement of beaded material 120. For instance, opposing rollers may be disposed against fabric 2 of beaded fabric 120, such as against uncut excess fabric 121. Rollers of this type may include rubberized outer portions for gripping fabric 2 therebetween.

FIG. 5B shows an alternative advancement mechanism arrangement to FIG. 5A that uses clamps, such as pneumatic clamps, to grip beaded fabric 120. A first clamp 156 disposed at the entryway to die cut press 122 may include an opposing pair of grips 158 and 160. Grips 158 and 160 may move towards and apart from each other as needed to grip or release beaded material 120 during production. Operation of clamp 156 may be controlled manually or via process control logic and a controller (not shown). Grips 158 and 160 may include rubberized material for compressibly engaging bead 1 and/or fabric 2. A second clamp 162, which is similar to clamp 156, is disposed at the exit of die cut press 122 to support and/or advance beaded fabric 120 at the opposite side of the die cut press. As shown, second clamp 162 may grip beaded fabric 120 and travel in the production direction to advance beaded fabric 120 subsequent to the die cutting operation. Once beaded fabric 120 is sufficiently advanced, second clamp 162 may release beaded fabric 120, travel back to its original position, and re-clamp beaded fabric 120 at a new location. A third clamp 163 may be used to retain beaded fabric 120 at its new location while second clamp 162 travels back to its original position, which may prevent the beaded fabric from being dragged by the second clamp or otherwise moved out of position until second clamp 162 is able to re-clamp it.

As shown in FIG. 5B, stops 165 may be used to assist accuracy and repeatability for advancing the beaded fabric 120. Stops 165 may be fixed along the production path of beaded fabric 120 at the desired limits of movement for the second clamp 162. The stops may be used in conjunction with process control logic and other operational parameters to advance beaded fabric 120 a desired index distance. The index distance may be relied upon by the die-cut press 122 to ensure uncut beaded fabric is drawn into it prior to press operations. It may also be relied upon for positioning beaded fabric 120 for subsequent processes, such as additional cutting operations.

To keep the cut tie-downs integrated within beaded fabric 2 after die cutting, and to improve the processing of tie-downs through die-cut press 122, nicks 5 may be formed in the cutting edge 19 of steel rule 4 at locations where bead 1 is to be cut. As shown in FIGS. 8 and 8A-8D, nicks 5 prevent the complete severing of bead 1, which permits a connecting portion 140 to remain at the cut area. Connecting portion 140 retains beaded fabric 120 in an integral unit even after the die cutting operation, which allows the cut parts to be fed/pulled from press 122 between subsequent to cutting operations. The cut parts can then be separated manually or automatically after the cutting operation. Connecting portion 140 is sufficiently small to permit the cutout tie-downs to be easily broken from the length of beaded fabric 120. Although shown as being generally rectangular, nicks 5 and connecting portion 140 can be of a curved shape or other desired shape.

Figures 8A, 8B, 8C, 8D:
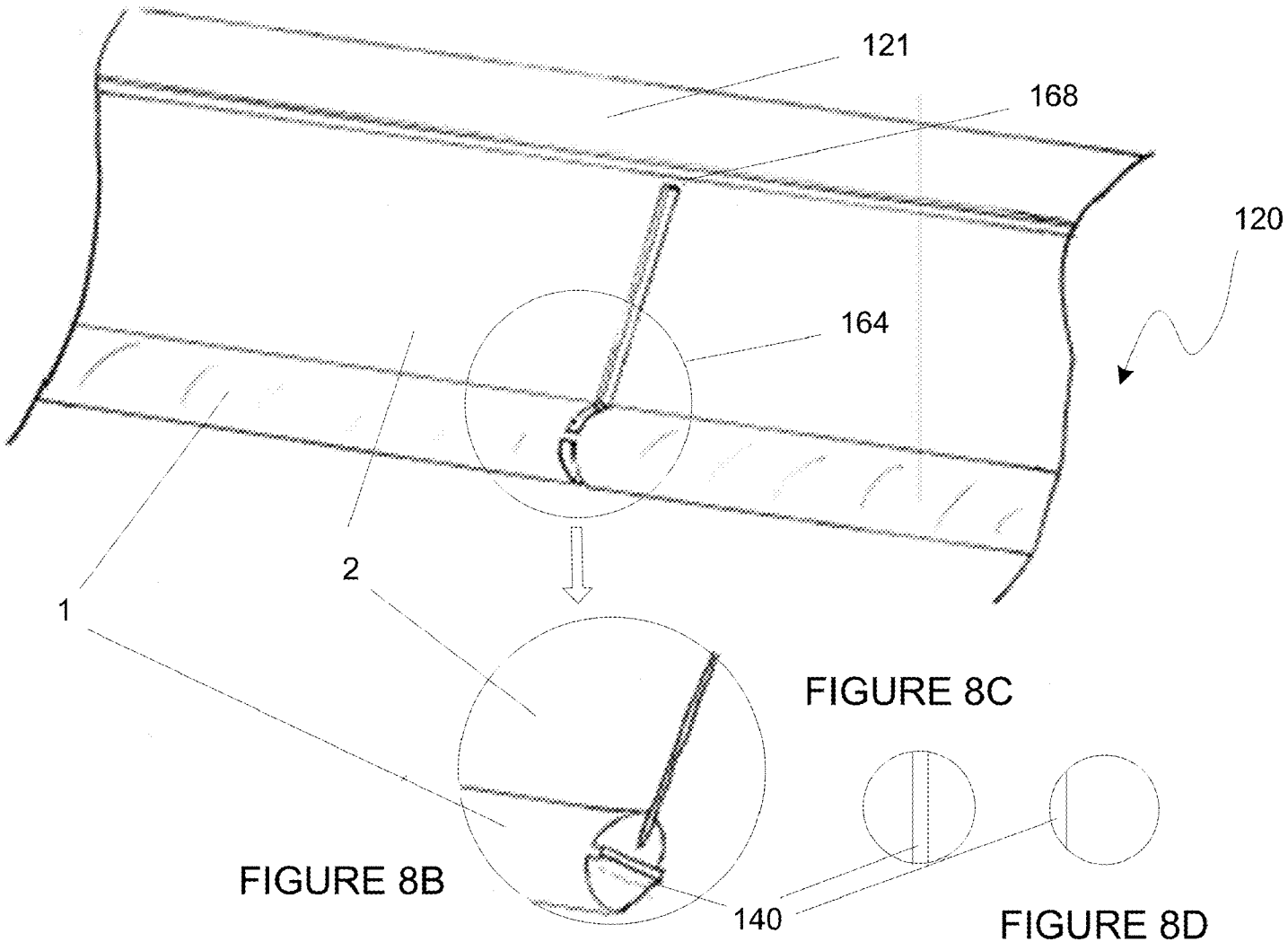
FIGS. 8A and 8B are perspective views of portions of beaded fabric according to the process of FIG. 2.
FIGS. 8C-8D are cross-sectional views of cut beads according to embodiments of the invention.

FIG. 8A shows a portion of beaded fabric 120 after it exits die cut press 122. As shown, large portions of bead 1 and fabric 2 have been cut through, but excess fabric portion 121, connecting portion 140 and fabric lands 168 remain intact to retain beaded fabric 120 as an integral unit. In alternate configurations, either or both of excess fabric portion 121 and fabric lands 168 may be eliminated. For instance, fabric lands 168 may be eliminated to provide cleaner cuts and beaded fabric 120 may be the final width of tie-downs 126 to eliminate excess fabric portion 121. At separation/packaging station 124, individual tie-downs 126 may be separated by breaking connecting portion 140 and fabric lands 168 (if used), and removing excess fabric portion 121 (if used). Enlarged view 164 of FIG. 8B shows bead 1 with a tab remaining from connection portion 140, which remains after individual tie-downs 126 are separated from each other.

FIGS. 8C-8D show various arrangements for forming connecting portion 140. FIG. 8C is a cross-sectional view of bead 1 from FIG. 8B without fabric 2 being shown. To form connecting portion 140 shown in FIG. 8C, nick 5 in steel rule 4 permits bead 1 to be cut on opposite sides. FIG. 8D shows a bead 1 according to another embodiment in which the nick in the steel rule is offset to one edge of the bead such that connecting portion 140 is on a lateral side of bead 1. Additional embodiments of connecting portion 140 are possible that retain tie-downs as part of beaded fabric 120 until separation/packaging station 124.

During the cutting operation of die-cut press 122, steel rule 4 presses slightly into cutting pad 22 (see FIG. 7), which may leave small grooves in the cutting pad. After several repetitions of the cutting cycle, grooves may become large enough to reduce the effectiveness of steel rule 4 for cutting through fabric 2. To prevent interruptions in the cutting process based on the adjustment of cutting pad 22 due to such grooves, and to extend the life of cutting pad 22, the pad is preferably moved a small lateral distance on a regular basis. This can be accomplished manually or by an automated device. For example, one or more stepper motors (not shown) may be set up to move cutting pad 22 mounted on rollers a small distance along two axes in the plane of platen 21. For instance, if lower platen 21 is horizontally oriented, stepper motors (not shown) may move cutting pad 22 after every third cutting operation a distance of ⅛" in a first horizontal direction (x-direction) and ⅛" in a second horizontal direction (y-direction) oriented approximately 90 degrees from the first direction. Alternatively, cutting pad 22 may simply rest against the lower platen such that it may be manually translated along the platen between cutting cycles.

Cutting pad 22 may be made from a variety of relatively stiff resilient materials, which preferably have a stiffness greater than or equal to that of resilient members 12. More preferably, cutting pad 22 is preferably made from a grade of polypropylene that has a stiffness greater than that of resilient members 12. As such, resilient members 12 compress to a larger degree during the die-cutting operation than cutting pad 22.

Optionally, cutting edge 19 of steel rule 4 may be serrated along its length to reduce the possibility of fraying fabric 2 along cut lines. FIG. 8 shows serrations 148 at the distal edge of cutting edge 19, which may enhance the cutting effectiveness of steel rule 4.

As another option, ejection foam (not shown) may be attached to upper platen 20 and disposed in a tie-down cut region 150 (see FIG. 4) within the boundaries of steel rule 4 and guide 206. Ejection foam pieces (not shown) are resilient pieces of foam that extend beyond the height of steel rule 4. Ejection foam pieces (not shown) encourage cut portions of fabric 2 to separate from steel rule 4 after cutting operations, which facilitates feeding the beaded fabric 120 into and out of die-cut press 122 between subsequent cuts. For instance, open-cell polyurethane sponge foam may be used as a base material for the ejection foam pieces and may be covered with a skin of closed-cell, cross-linked polyethylene foam (e.g., about 1/16"), which can help to keep the foam pieces from gripping the beaded fabric 120.

Figure 9:
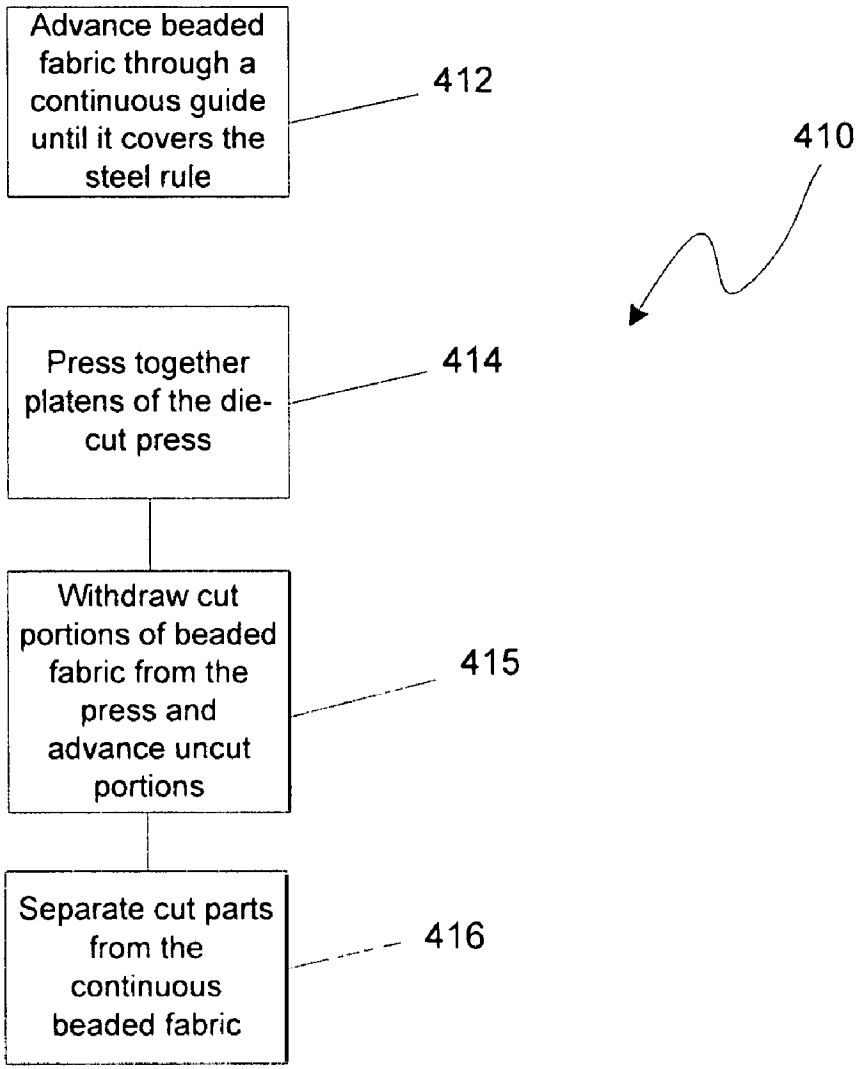
FIG. 9 illustrates a method for forming tie-downs according to the process of FIG. 2.

Referring now to FIG. 9, a method 410 for forming tie-downs 126 from beaded fabric 120 is generally shown. Method 410 is described according to the aspects and preferences described above along with process 110; however, the steps of method 410 may be practiced along with other processes. As such, beaded fabric 120 may be provided on roll 118 in accordance with process 110 described above, or as part of a continuous production process in which beaded fabric 120 is serially formed substantially concurrently along with the steps of method 410. In accordance with method 410, beaded fabric 120 is pulled through die-cut press 122 and into position via a suitable feeding means, which may include a roll feed system, a shuttle feed system or manual feeding as previously discussed (at first entry end). For example, as shown in FIG. 5, clamp 162 connected to a feed system (not shown) may clamp onto beaded material 120 and advance it as needed before and after die-cutting operations. In operation, beaded fabric 120 is fed into a forward portion of guide 206 via bead 1 entering channel 10. Beaded fabric 120 then advances 412 through a continuous guide, such as the central portion of guide 206, which extends the length of steel rule 4 such that uncut beaded fabric 120 covers steel rule 4. Optionally, a separate pre-alignment guide, such as guide 106 shown in FIG. 13, may be provided to pre-align beaded fabric 120 prior to entry into guide 206.

Once beaded fabric 120 is in position, platens 20 and 21 are brought together 414 until cutting edge 19 of steel rule 4 penetrates beaded fabric 120 and protrudes slightly into cutting pad 22, which ensures it cleanly cuts through beaded fabric 120. As platens 20 and 21 are closed, resilient members 12 are compressed to allow steel rule 4 to extend through beaded fabric 120. The die may also be fitted with punches 15 (see FIG. 4) or marker notches 16 for cutting inner portions of tie-downs 126 along with the perimeter of tie-downs 126. Bead 2 is cut by steel rule 4 with the exception of connecting portion 140 (see FIG. 8). Retaining connecting portion 140 aids the continuous feeding of the cut parts integrally formed in beaded fabric 120. As such, cut portions of beaded fabric may be drawn 415 out of die-cut press 122 as uncut beaded fabric 120 is advanced into die-cut press 122. The parts are separated 416 from the continuous length of beaded fabric 120 in a secondary operation.

Figure 10:
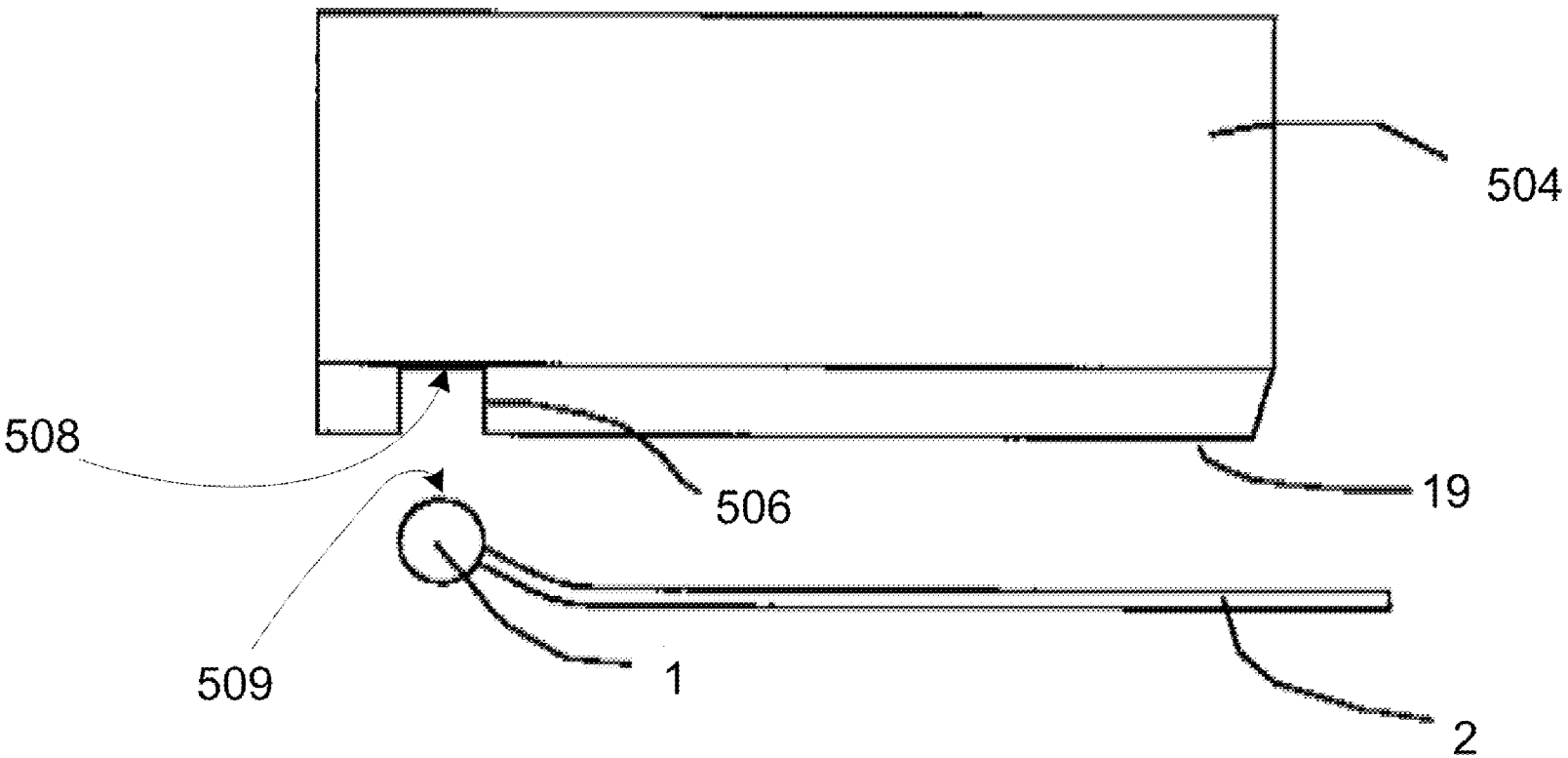
FIG. 10 is a front view of a portion of a cutting die according to an embodiment of the invention.
Figure 11:
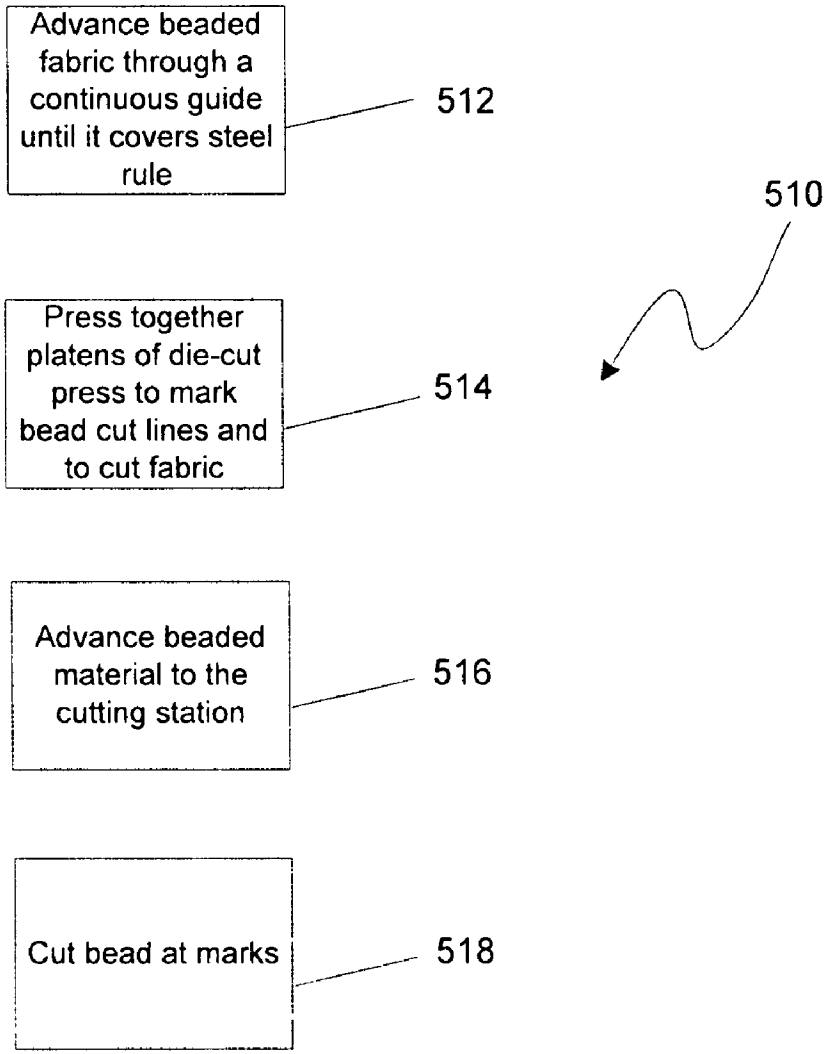
FIG. 11 illustrates a method for forming tie-downs according to another embodiment of the invention.
Figure 12:
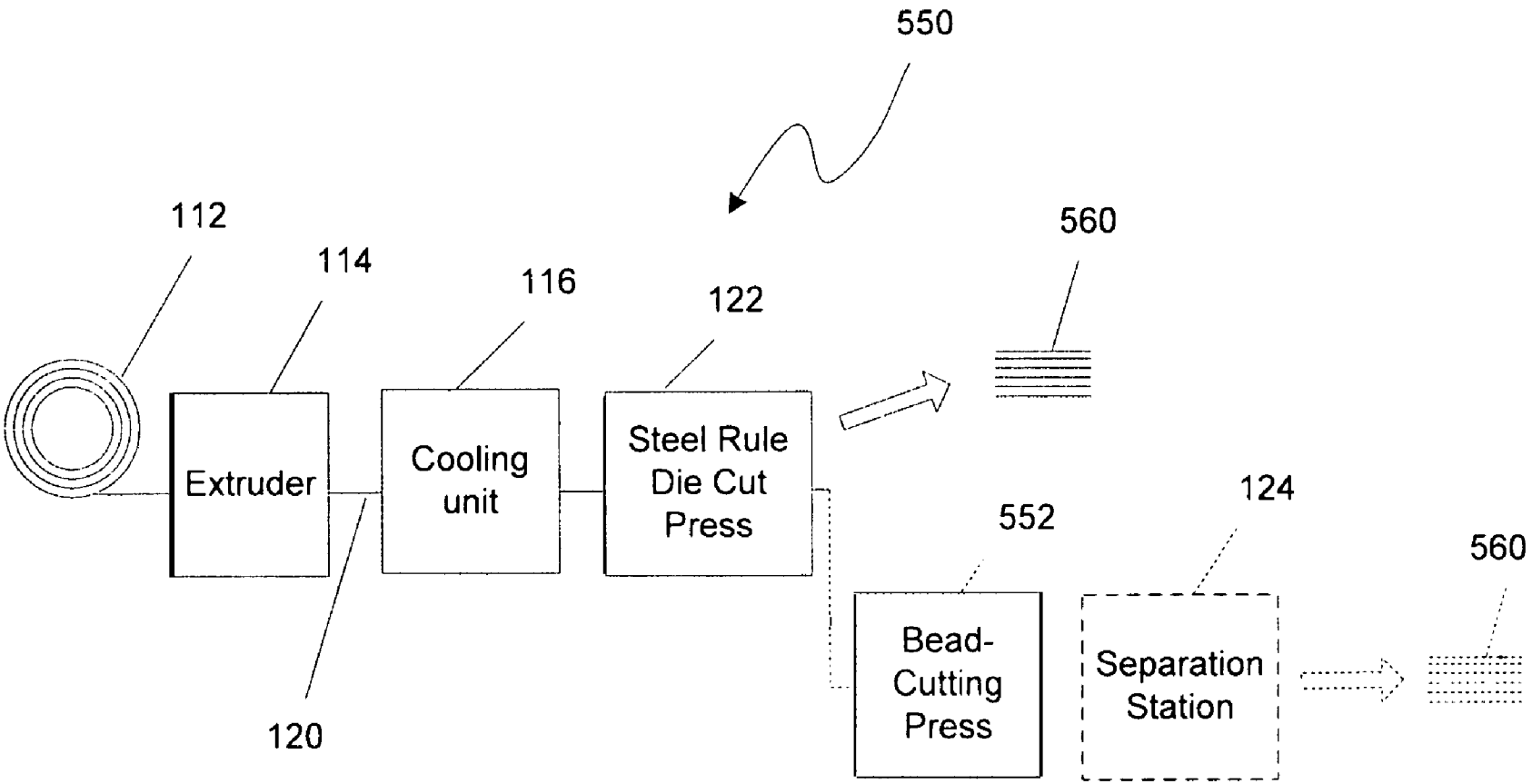
FIG. 12 illustrates a continuous process for forming tie-downs according to further embodiments of the invention.

Referring now to FIGS. 10-12, a method 510 is shown for forming tie-downs from beaded fabric according to another embodiment of the invention, as well as a steel rule 504 having a marking mechanism according to a further embodiment of the invention, and a continuous process 550 for forming tie-downs according to yet another embodiment of the invention. Method 510, steel rule 504 and continuous process 550 generally include the above-described aspects and preferences, except as discussed below. As shown in FIG. 10, steel rule 504 includes a marking nick 506 formed in cutting edge 19. Marking nick 506 places a mark 509 (FIGS. 5 and 10) on bead 1 for use in determining a cut location for forming a tie-down 126. The mark 509 may include a compression formed via a marking edge 508 of nick 506 contacting bead 1 during a die-cut operation, depending on whether the marking edge 508 of nick 506 is sharpened to pierce bead 1 or is substantially flat to form a compression indentation on bead 1. It is contemplated that the mark 509 may also be formed via an optically sensible indicator on the bead, such as an ink mark on bead 1. Marking bead 1 at cut locations, rather than partially cutting bead 1 as in previous embodiments, provides a more rigid beaded fabric 120 subsequent to die-cutting operations. Thus, bead 1 has a higher tensile strength after die-cut operations, which permits bead 1 to be pulled for advancing beaded fabric 120 with less risk of breaking bead 1 at cut lines.

As shown in FIG. 11 for method 510, beaded fabric 120 is advanced 512 through continuous guide 206 (as described above for method 410) to cover steel rule 4 in preparation for die cutting. Once beaded fabric 120 is in position, die-cut press 122 presses 514 platens 20 and 21 together to cut fabric 2 and to mark bead 1. Because of the tensile strength of substantially uncut bead 1, beaded fabric 120 may be advanced by pulling beaded fabric 120 from die-cut press 122 with little risk of breakage. Subsequently, beaded fabric 120 is advanced 516 to a bead-cutting station, which may be part of separation/packaging station 124, and bead 1 is cut 518 as indicated by the marks 509 (FIGS. 5 and 10). The marks 509 may indicate actual cut locations, or they may be used for controlling the location of bead 1 during cutting at a different point. Tie-downs 126 may easily be separated from the remainder of beaded fabric 120 after bead 1 is cut as indicated by the marks. In order to gather scrap remaining from beaded fabric 120 after tie-downs 126 are removed, a rewind stand (not shown) may wind scrap fabric onto a roll for recycling or for other uses.

Preferably, marks are sensed via an automatic device, such as a fiber optic laser beam sensor that identifies disruptions along bead 1 or via a vision system. As such, beaded fabric 120 may be advanced or retracted as necessary to place one or more marks in line with a sensor or a cutting mechanism such as a cutting die, a shear, a laser cutter, etc. Preferably, multiple marks are cut simultaneously to improve processing. For instance, beaded fabric 120 may be advanced to a die-cut press (not shown) that aligns a first mark with a sensor, and the die-cut press may operate to make multiple cuts in beaded fabric 120. In another example, as shown in FIG. 5B, beaded fabric 120 may be advanced an index amount and the die-cut press may operate to make the multiple cuts in the beaded material after each indexing operation.

FIG. 12 shows a continuous process 550 according to further embodiments of the invention for forming tie-downs 126. Process 550 illustrates that the operations of process 110 shown in FIG. 2, the steps of method 410 shown in FIG. 9, and/or the steps of method 510 shown in FIG. 11 may be combined as desired into a continuous process. As such, beaded fabric 120 is formed as part of a continuous process, which may be on a single production line. Tie-downs 560 may subsequently be formed in the beaded fabric and separated therefrom at separation station 124.

In another embodiment also represented in FIG. 12, it is possible to completely cut the fabric and bead at steel rule die cut press 122 and have the finished tie-down pushed through the cutting operation and separated from the beaded fabric as it exits the die cut press 122. Such an embodiment may eliminate the bead cutting press 552 and the separation station 124. For this embodiment, the second pair of opposing rollers 154 of FIG. 5B may be eliminated and the first pair of opposing rollers 152 placed at the entry to the cutting press can push the beaded fabric into the die cut press, as well as push the cut tie-downs 560 out of the die cut press. Further, first pair of opposing rollers 152 may include two sets of feed rolls placed at the inlet to the press, which can aid in alignment of the beaded material and increase the pushing force in comparison with a single set of feed rollers.

While the present invention has been described in connection with the illustrated embodiments, it will be appreciated and understood that modifications may be made without departing from the true spirit and scope of the invention. In particular, the invention applies to many different types of production lines and various types of tie-downs or similar items.

I claim:

1. A method for cutting beaded fabric, the method comprising:

advancing a substantially continuous length of beaded fabric through a generally continuous guide disposed in a die press until the breaded fabric substantially covers a steel rule disposed within the die press, the beaded fabric including a bead;

pressing a cutting edge of the steel rule through fabric of the beaded fabric;

withdrawing a cut portion of the continuous length of beaded fabric from an exit end of the guide while simultaneously advancing an uncut portion of the continuous length of beaded fabric into an entrance end of the guide; and separating the cut portion from the continuous length of beaded material including:

separating a bead section associated with the cut portion from the remainder of the bead; and breaking a connecting portion between the bead section and the remainder of the bead, the connecting portion having a reduced cross-section from the remainder of the bead.

2. The method of claim 1, further comprising placing a mark on the bead of the continuous length of beaded fabric.

3. The method of claim 2, further comprising sensing the mark, wherein breaking the connecting portion is performed in response to sensing the mark.

4. The method of claim 2, wherein placing a mark includes pressing a marking surface of the steel rule die against the bead.

5. The method of claim 4, wherein pressing includes placing a mark on a bead of the continuous length of beaded fabric.

6. The method of claim 1, wherein breaking the connecting portion includes cutting through the bead.

7. The method of claim 1, further comprising:

attaching a tie-down to fabric for a seat, the tie-down including the cut portion of beaded fabric; and connecting the tie-down to a frame for the seat.

8. The method of claim 7, wherein, for attaching the tie-down, the seat is an automobile seat.

9. The method of claim 8, further comprising installing the automobile seat in an automobile.

10. The method of claim 1, further comprising periodically translating a cutting pad along a plane substantially parallel with a platen of the die press.

11. The method of claim 10, wherein the cutting pad is translated after each time the step of pressing a cutting edge is performed.

12. The method of claim 1, wherein, for pressing a cutting edge of the steel rule through fabric of the beaded fabric, the cutting edge includes serrations.

13. The method of claim 1, wherein breaking the connecting portion includes cutting through the connecting portion.

14. The method of claim 1, further comprising forming a hole through the fabric of the beaded fabric, wherein, for the step of withdrawing a cut portion, the cut portion includes the hole.

* * * * *